US008068618B2

(12) United States Patent
Vollmer

(10) Patent No.: US 8,068,618 B2
(45) Date of Patent: Nov. 29, 2011

(54) SPHERICAL LOUDSPEAKER FOR OMNIPRESENT SOUND REPRODUCTION

(76) Inventor: Edward G. Vollmer, San Jose, CA (US)

( * ) Notice: Subject to any disclaimer, the term of this patent is extended or adjusted under 35 U.S.C. 154(b) by 1650 days.

(21) Appl. No.: 11/327,457

(22) Filed: Jan. 9, 2006

(65) Prior Publication Data

US 2007/0160246 A1 Jul. 12, 2007

(51) Int. Cl.
*H04R 1/02* (2006.01)
*H04R 9/06* (2006.01)

(52) U.S. Cl. ..... 381/89; 381/336; 381/335; 381/386; 181/153

(58) Field of Classification Search ..... 381/337, 381/338, 345, 349, 351, 421, 424, 182, 184, 381/186, 386, 391, 335, 336; 181/153
See application file for complete search history.

(56) References Cited

U.S. PATENT DOCUMENTS

| | | | | |
|---|---|---|---|---|
| 2,689,016 | A * | 9/1954 | Lang | 181/145 |
| 3,326,321 | A | 6/1967 | Valuch | |
| 3,483,945 | A | 12/1969 | Stanley | |
| 3,500,953 | A * | 3/1970 | Lahti | 181/151 |
| 3,812,301 | A * | 5/1974 | Lahti | 381/341 |
| 3,816,672 | A | 6/1974 | Gefvert et al. | |
| 3,961,684 | A | 6/1976 | Michael et al. | |
| 4,308,431 | A * | 12/1981 | Hanbicki | 381/191 |
| 4,336,861 | A | 6/1982 | Peter | |
| 4,420,061 | A | 12/1983 | Levy | |
| 4,440,259 | A | 4/1984 | Strohbeen | |
| 4,580,654 | A | 4/1986 | Hale | |
| 4,989,254 | A * | 1/1991 | Amalaha | 381/424 |
| 5,073,945 | A * | 12/1991 | Kageyama et al. | 381/89 |
| 5,086,871 | A | 2/1992 | Barbe | |
| 5,115,882 | A | 5/1992 | Woody | |
| 5,227,591 | A | 7/1993 | Tarkkonen | |
| 5,436,976 | A | 7/1995 | Dougherty | |
| 5,444,194 | A * | 8/1995 | Reinke | 181/150 |
| 5,451,726 | A | 9/1995 | Haugum | |
| 5,701,358 | A * | 12/1997 | Larsen et al. | 381/423 |

(Continued)

FOREIGN PATENT DOCUMENTS

WO 2007/081408 A1 7/2007

OTHER PUBLICATIONS

International Preliminary Report on Patentability for PCT/US2006/034333, dated Jul. 15, 2008, 5 pages.

(Continued)

*Primary Examiner* — Xu Mei
(74) *Attorney, Agent, or Firm* — Lewis and Roca LLP

(57) ABSTRACT

A highly compact loudspeaker system having a spherical housing produces time and phase coherent sound waves in an omnipresent manner throughout a spatial listening environment. Within is a relatively low frequency sound driver and a relatively high frequency sound driver. The spherical housing has upper and lower hemispherical halves. The upper half is hollow and has holes through its surface over most of its surface. The lower half forms a sound compression propagation vacuum chamber for the low frequency driver. Mounted within the lower half is a crossover network conventionally connected to the sound drivers. Acoustic foam lines the interior wall surface of the lower half. The low frequency sound driver is mounted inverted, into the open end of the lower half, and then sealed air tight, at a lowered atmospheric pressure, while the high frequency sound driver is mounted upwardly, affixed to the backside of the low frequency driver.

21 Claims, 4 Drawing Sheets

U.S. PATENT DOCUMENTS

| | | | | |
|---|---|---|---|---|
| 5,847,331 | A | 12/1998 | Vollmer et al. | |
| 5,952,620 | A * | 9/1999 | Hamilton et al. | 181/153 |
| 6,009,972 | A * | 1/2000 | Choi et al. | 181/155 |
| 6,186,269 | B1 | 2/2001 | Vollmer et al. | |
| 6,353,670 | B1 * | 3/2002 | Gasner | 381/96 |
| 6,431,308 | B1 | 8/2002 | Vollmer et al. | |
| 6,856,692 | B2 | 2/2005 | Lin | |
| 7,027,610 | B1 | 4/2006 | Kihara | |
| 7,886,867 | B2 * | 2/2011 | Adams | 181/148 |

OTHER PUBLICATIONS

Written Opinion of the International Searching Authority for PCT/US2006/034333, dated Feb. 8, 2007, 4 pages.

International Search Report for PCT/US2006/034333, dated Apr. 24, 2007, 1 page.

* cited by examiner

SPHERICAL LOUDSPEAKER FOR OMNIPRESENT SOUND REPRODUCTION

FIELD OF THE INVENTION

The present invention generally relates to electronic speakers, and, more specifically, to a spherical omnipresent loudspeaker, which reproduces and processes input signals, and projects corresponding sound outputs, which propagates coherent sound waves in a true time and phase spherical omnipresent manner, throughout a spatial listening environment.

BACKGROUND OF THE INVENTION

Conventional loudspeakers systems currently typically employ two or more speakers for sound reproduction, more particularly, in musical reproduction. Standard loudspeakers are usually arranged in such a manner so that the drivers must face the listening audience. These loudspeakers, are generally constructed to include sound drivers to reproduce a relatively high, medium, and low frequency sound range. This manner of speaker arrangement results in the reproduction of sound waves in a highly directed conic wedge, thereby setting off standing waves, wave cancellation, and wave pileup. This results in an area where two speakers of this design can create true stereo reproduction. Typical loudspeaker systems of this design and arrangement also tend to block the sound created by another such system, and there is only a small area, if any, where coherent sound is produced. The directional problems of such systems, as well as the placement problems presented by the speakers, create large areas of non-coherent sound with non-adequate stereo resolution, producing an undesirable, unrealistic sound reproduction.

The prior art herein disclosed has proposed speaker arrangements for achieving omnidirectional sound propagation. Examples can be seen in U.S. Pat. No. 3,326,321 issued to Valuch on Jun. 20, 1967; U.S. Pat. No. 3,483,945 issued to Stanley Michael on Dec. 16, 1969; U.S. Pat. No. 3,816,672 issued to Gefvert et al. on Jun. 11, 1974; U.S. Pat. No. 3,961,684 issued to Michael et al. on Jun. 8, 1976; U.S. Pat. No. 4,336,861 issued to Peter on Jun. 29, 1982; U.S. Pat No. 4,420,061 issued to Levy on Dec. 13, 1983; U.S. Pat. No. 4,440,259 issued to Strohbeen on Apr. 3, 1984; U.S. Pat No. 4,580,654 issued to Hale on Apr. 8, 1986; U.S. Pat. No. 5,086,871 issued to Barbe on Feb. 11, 1992; U.S. Pat. No. 5,115,882 issued to Woody on May 26, 1992; U.S. Pat No. 5,227,591 issued to Tarkkonen on Jul. 13, 1993; U.S. Pat. No. 5,436,976 issued to Dougherty on Jul. 25, 1995; U.S. Pat. No. 5,451,726 issued to Haugum on Sep. 19, 1995; U.S. Pat No. 5,847,331 issued to Vollmer, et al. on Dec. 8, 1998; U.S. Pat No. 6,186,269 issued to Vollmer, et al. on Feb. 13, 2001; and U.S. Pat No. 6,431,308 issued to Vollmer, et al. on Aug. 13, 2002. The subject, speaker in each case lacks the precise arrangement of drivers ,and sound compression vacuum propagation chambers, contained within the spherical housing as seen in the present invention. None of the above inventions and patents taken either singly or in combination, is seen to describe the instant and novel invention in whole or in part as claimed.

BRIEF SUMMARY OF THE INVENTION

The present invention sets forth a new and unique revolutionary construction, in various sizes, for a spherical loudspeaker system, for producing sound waves from an input signal source. Sound waves are propagated in a time and phase coherent, spherical omnipresent manner. The novel loudspeaker reproduces extraordinary fidelity sound, which propagates omnipresently to and throughout the listening audience. The novel loudspeaker design can be used in a variety of applications, i.e. consumer sound systems including 2.0 through 7.1, surround sound home theater systems, commercial use, personal computers, 2.0 through 7.1 with use of external PMOP amplification, audiovisual, and live performance music. The sound waves emanate omnipresently, in the same manner the human ear perceives them in time and space. The novel loudspeaker reproduces the full audio frequency response, 20 Hz-20 kHz+/−3 db. Remarkably, the quality and volume of sound produced by the novel speaker, for its size, large or small, is nothing short of astonishing.

The preferred embodiment is that of a sphere, which is divided into two hemispherical halves. Typically, a first, preferably lower-most portion, or hemispherical half, is a sound compression propagation vacuum chamber. A low-frequency sound driver is mounted and sealed air-tight in this half at a reduced atmospheric pressure. One, or optionally more, pair of input signal terminals are incorporated within the lower sound chamber and connected to a crossover network, which is, in turn, conventionally connected to one or more sound drivers. Acoustic foam is fitted onto the interior walls of the lower sound compression propagation vacuum chamber. An acrylic mounting plate disk is prepared by having its central portion being drilled and taped to accommodate the low frequency sound driver. The low frequency sound driver is inverted, mounted onto the prepared acrylic mounting plate disk by means of, for example, screws. Optionally, the mounting plate disk can be made from ABS or PVC plastic, bioplastic or injection molding, or hydro-forming out of metal for the lower hemispherical half and its mounting plate disk as a unit. Incorporated into the driver mounting plate disk is typically an air vacuum valve used to extract air from first hemisphere sound compression propagation vacuum chamber with, for example, an aerospace type vacuum. A crossover network is incorporated inside the bottom of this first (preferably lower) hemispherical half sound compression propagation vacuum chamber and the vacuum chamber's interior walls are lined with acoustic foam. The crossover network's outputs are conventionally connected to the sound driver or drivers, and connected to a pair of speaker input terminals that are mounted into and through the first hemispherical sound chamber and connected to crossover inputs. Optionally, the loudspeaker can have one, two or three pairs of input signal terminals for connection to personal computers, or home audio or powered subwoofers with satellite output signal sources for surround sound systems.

The second, typically upper, hemispherical half of said sphere is used as a free air sound reinforcement screen cover and speaker cover for the lower sound chamber and its components. It is preferably covered with a grille cloth type material, such as acoustic transmitting polyester knit, and has a variety of holes drilled into and through it, for example, thirty-six ⅛ inch holes per square inch over its entire surface. An open bottom rim of the upper hemispherical half is preferably fitted with a finish trim ring, and then is fitted over and onto the lower-most portion of the sound compression propagation vacuum chamber. The low frequency driver, with air valve and mounting plate disk, is mounted onto and into the upper-most portion of the lower hemispherical half of the sound compression propagation vacuum chamber and sealed air tight. The atmospheric pressure in the sound compression propagation vacuum chamber is evacuated via the air valve, typically through use of a vacuum pump. The upper hemispherical half is then affixed over the top of the sound compression propagation vacuum chamber, completing the omnipresent spherical loudspeaker.

Accordingly, it is one object of the present invention to provide a speaker which propagates time and phase coherent sound waves in a seemingly omnipresent spherical manner through a spatial listening environment in such a manner the human ear perceives it in time and space omnipresently.

It is a further object of the present invention, to provide improved elements and arrangements, thereof, in a unique and novel apparatus for the purposes described which is inexpensive, dependable and fully effective in accomplishing its intended purposes.

DETAILED DESCRIPTION OF THE INVENTION

Figure 1:
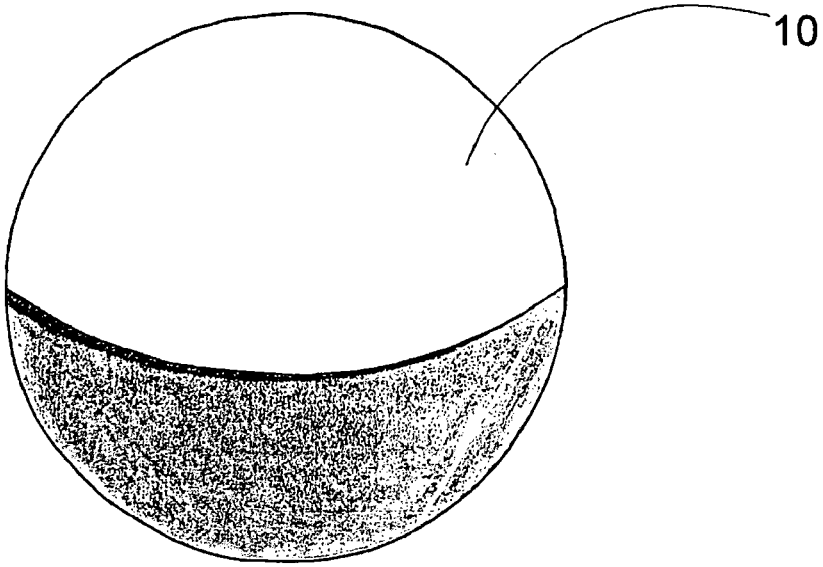
FIG. 1 illustrates a perspective view of the outside of a spherical loudspeaker system, in accordance with a preferred embodiment of the present invention.

Typically, it is relatively easy to determine the location of sound sources, such as one or more speakers in a room, by moving either one's head or one's body around. This is contrasted with the present invention, where the sound projected does not appear to come from any single identifiable location, even when utilizing the means we usually do to detect the location of a sound source. Herein then, the definition of "omnipresent" sound means that the sound is relatively difficult, if not impossible, to determine the location of sound being projected by this loudspeaker system through normal usage of human senses.

The present invention thus sets forth a new and unique revolutionary construction, in various size, for a spherical loudspeaker system for producing sound waves from an input signal source. Sound waves are propagated in a time and phase coherent, seemingly omnipresent manner. The novel loudspeaker system reproduces sound with extraordinary fidelity, which propagates omnipresently to and throughout the listening audience. The novel loudspeaker design can be used in a variety of applications, i.e. consumer sound systems, including 2.0 through 7.1 surround sound systems, home theater, commercial use, personal computers 5.1 to 7.1" audiovisual, and live performance music. The novel spherical loudspeaker system reproduces sound in an omnipresent manner, throughout a spatial listening environment i.e. air. The sound waves emanate omnipresently, in the same manner that the human ear perceives them in time and space. The novel speaker system reproduces the full audio frequency response, 20 Hz –~20 kHz, +/−3 db. Remarkably, the quality and volume of sound produced by the novel speaker system is, for its size, large or small, nothing short of astonishing.

The novel loudspeaker system has, in design, various sizes. The embodiment herein is preferably that of a sphere. The sphere is divided into two halves. The lower hemispherical half is preferably a sound compression propagation chamber. In a preferred embodiment, the upper hemispherical half has a variety of holes, for example, thirty-six ⅛" holes per square inch, drilled or formed into and through its hemispherical upper half. This upper portion is typically used as a hemispherical speaker cover and is preferably covered in a grille cloth-type material, such as acoustic transmitting polyester knit. The open bottom rim of the upper hemispherical half is fitted with a finish trim ring. A crossover network is incorporated typically inside the bottom of the lower hemispherical half and is conventionally connected to one or more sound drivers. Also, the loudspeaker system has one or more pair of input signal terminals for connection to various output devices, such as, for example, home audio amplifiers, personal computers, or powered subwoofers, with satellite output signal sources for surround sound systems. Acoustic foam is preferably fitted onto the interior wall of the lower hemispherical half. The lower hemispherical portion now forms a sound compression propagation chamber. A low frequency driver is inverted, mounted, for example, onto an acrylic mounting plate disk, by means of, for example, screws or glue. The low frequency driver, with mounting plate disk, is mounted inverted, onto and into the upper-most portion of the lower hemispherical half, slightly (½" in a preferred embodiment) below the rim formed on the open end of the hemispherical sound compression chamber. The upper hemispherical half is affixed over the top of the lower hemispherical sound propagation chamber, completing the omnipresent sphere loudspeaker system. The novel speaker configuration and characteristics of the sphere, sound compression chamber, and its components efficiently maximize performance of the novel loudspeaker.

The present invention is a highly compact spherical loudspeaker system, which propagates time and phase coherent sound waves in an omnipresent manner throughout a spatial listening environment. The novel omnipresent loudspeaker housing is a sphere, approximately 6.0" in diameter in an illustrative embodiment, but is not limited to this size. The spherical housing is typically comprised of two hemispherical halves, the upper hemispherical half is hollow and, in a preferred embodiment, has thirty-six ⅛" holes per square inch drilled through its surface over the entire surface of the hemispherical upper half. Again, in the preferred embodiment, there is a ½" rim at its open end where no holes are drilled, the rim receiving a decorative finish trim ring. The upper hemispherical half of the housing is then preferably covered in a grille cloth material, such as acoustic transmitting polyester knit, by means of, for example, spray adhesive, 3M-type or other. A decorative finish trim ring is preferably fitted onto and around the bottom rim of the open end of the upper hemispherical half. The upper hemispherical portion, is used as a free air sound reinforcement chamber and speaker cover. Both upper and lower hemispherical halves are preferably made of polyvinyl chloride (PVC) or acrylonitrile butadiene styrene (ABS). Optionally, the two hemispherical halves can be made of other materials. For example, only the upper half may be made of perforated screen material, such as aluminum with approximately 76 holes per square inch. Other materials are also within the scope of this invention.

Supported within the spherical housing of the novel omnipresent loudspeaker system is a relatively low frequency sound driver, a relatively high frequency sound driver, and, optionally, an intermediate frequency sound driver. This housing can be made to hold one or more sound drivers of the same or different frequencies, in any combination therein. The lower hemispherical housing is preferably a sound compression propagation vacuum chamber. In a preferred embodiment, the low frequency sound driver is inverted and mounted onto a mounting plate disk, for example, by means of a seal gasket and screws. In a preferred embodiment, an acrylic disk is utilized as the low frequency sound driver's mounting plate or disk. The inner-most portion of the low frequency sound driver's mounting plate disk is cut out to accommodate the low frequency driver. The lower hemispherical sound compression propagation vacuum chamber preferably has a crossover network mounted into and onto its interior wall bottom thereof. Incorporated into and through the lower hemispherical sound compression propagation vacuum chamber are one or more input terminals, which connect to and drive a crossover network. Each of the input terminals typically has positive and negative connectors and is connected by conductors to its crossovers terminals. The other ends of these conductors are connected to the positive and negative input terminals, within and through the lower hemispherical sound chamber. The crossover network typically has one pair of output terminals for each driver installed. Each pair has a positive and a negative. In the preferred embodiment, there are two pairs of conductors which feed from the crossover network's output terminals through a, for example, ¼" hole in the low frequency sound driver's mounting plate disk, whereby one pair of conductors are connected to the low frequency sound driver positive and negative terminals, and the second pair of the conductors is connected to the high frequency sound driver positive and negative terminals.

In the preferred embodiment, an upwardly facing high frequency sound driver is bonded to the back side of the inverted low frequency sound driver by means of, for example, liquid steel (such as J B Weld type or other). Alternatively, it may be drilled and tapped to accommodate metal threaded fastening studs. Preferably, acoustic foam padding is then provided throughout the interior walls of the lower hemispherical sound compression propagation vacuum chamber. The inverted low frequency sound driver, is mounted onto the mounting plate disk, then sealed air tight onto and into the upper-most portion of the lower hemispherical sound propagation vacuum chamber, preferably approximately ½" below the rim at the top of lower hemispherical sound compression propagation vacuum chamber.

The upper hemispherical half, which serves as a free air sound reinforcement chamber and speaker grille cover, is fitted over and onto the lower hemispherical sound compression propagation vacuum chamber, completing the novel spherical omnipresent loudspeaker.

The lower hemispherical sound compression propagation vacuum chamber acts with the inverted low frequency sound driver, when a low frequency sound driver has been installed into an air tight speaker enclosure and an input signal is sent to the low frequency sound driver. The low frequency sound driver's voice-coil and its attached cone move forward and backward in the sealed enclosure in accordance with the varying polarity of the signal applied to the voice-coil. As the voice-coil moves in the field of the permanent magnet, voltage is induced in the voice-coil to oppose the voltage applied to the voice-coil. This is termed "Counter-EMF". Since Counter-EMF opposes the original signal, it holds back, or damps, the voice-coil movement. In the prior art, in this type of application, the thermal conditions rise as the sound driver changes the volume of air inside the box by compressing it, raising both the pressure and the temperature inside the enclosure, thereby creating a strong probability that the sound driver used at a relatively high volume will cause damage, or even completely burn out, of the sound driver's voice-coil. The present invention overcomes this problem.

In the present invention, when the novel omnipresent loudspeaker receives an input signal to its low frequency sound driver, installed onto and into the upper-most portion of the lower hemispherical half sound compression propagation vacuum chamber, the inverted low frequency sound drivers voice coil and attached cone, are pushed down from the driver's normal resting place approximately ⅛" (in the illustrative embodiment with a 6.0" diameter lower hemispherical half) and then sealed air tight onto the lower hemispherical sound chamber. In this type of novel application, the thermal conditions are much lower then conventional loudspeakers, thereby allowing the driver's voice coil, attached cone, and the permanent magnet temperature, to remain relatively stable at all times, whenever an input signal is received. One reason for this phenomenon is that since the low frequency sound driver is mounted facing into the lower hemispherical sound compression propagation vacuum chamber, the sound driver's voice coil and magnet are mounted outside in the ambient air, instead of inside a typical sealed or semi-sealed speaker enclosure.

When the sound driver is installed approximately ⅛" (in this illustrative embodiment) below its normal resting place and sealed air tight onto the upper-most portion of the lower hemispherical sound compression propagation vacuum chamber, a volume of air of approximately of 9 cubic inches (in this illustrative embodiment) is compressed in the lower hemispherical sound chamber. When there is no input signal applied, the sound driver tries to pull back to its normal resting place, thereby creating a small vacuum force within the sound chamber. The approximate 9 cubic inches (in this illustrative embodiment) of compressed air volume acts as an opposing vacuum force, which is equal to and counteracts the force of the sound driver pulling back to its resting position, thereby allowing the low frequency sound driver to remain suspended between its resting place and its high excursion point. When a signal is applied to the low frequency sound driver, as the amplitude increases, the amount of compression becomes equal to the amount of vacuum, thereby allowing the drivers voice coil and attached cone to remain virtually motionless under load when the sound output is applied and amplified to the novel omnipresent loudspeaker. Therefore, this type of application is much more efficient in performing its intended use in an apparatus that is both simple in design and economical to construct, than today's conventional loudspeakers. When the sound drivers are installed into a spherical housing in the manner prescribed herein, the relationship of the sound drivers with the spherical housing results in sound quality and propagation characteristics that are truly capable of propagating time and phase coherent sound waves, in an omnipresent manner, throughout a spatial listening environment.

The speaker deflection and air volumes specified above are approximate for the illustrative embodiment of a 6.0" diameter sphere. These values are illustrative only, and it should be understood that the amount of air evacuated from the sound compression vacuum chamber must be adjusted accordingly for the actual sizes of the sound compression vacuum chamber and the low frequency sound driver utilized. Additionally, some minor amount of experimentation may be required to achieve optimal results, well within the expertise of an engineer reasonably skilled in this area, such as adding or removing air from the sound compression vacuum chamber in order to optimally tune the spherical omnipresent loudspeaker system.

Figure 2:
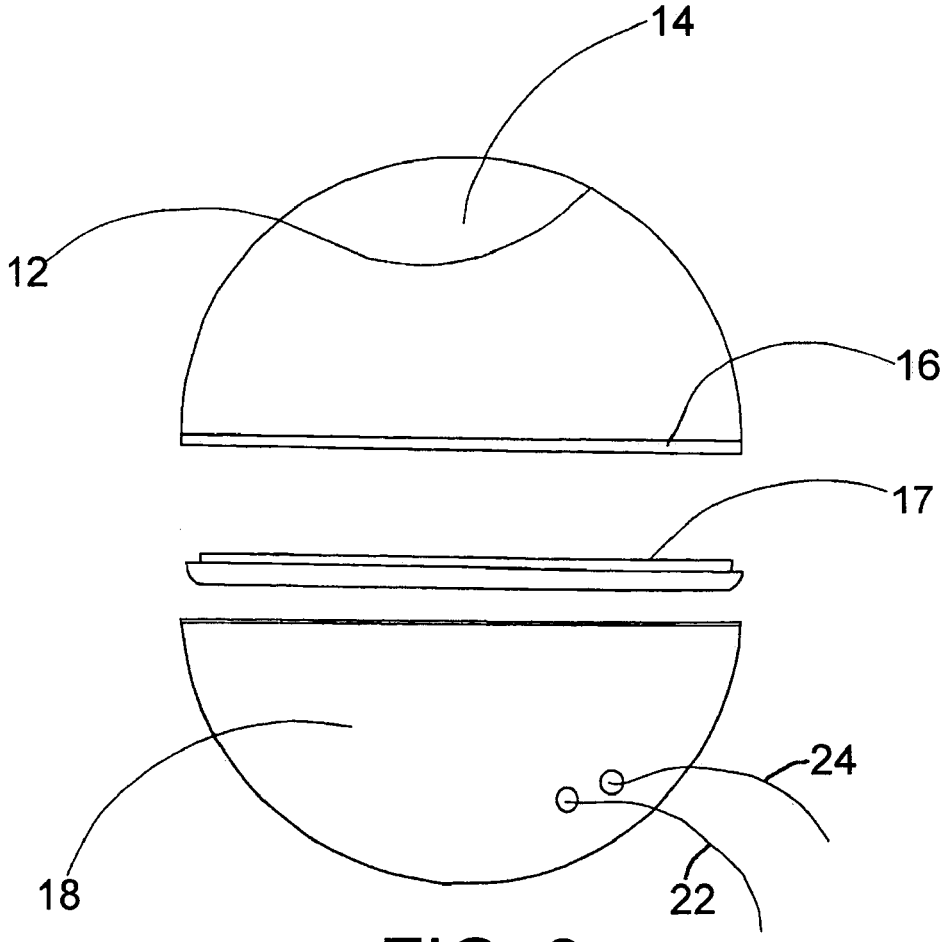
FIG. 2 illustrates an exploded side view of the outside portions of a spherical loudspeaker system shown in FIG. 1.

FIG. 1 illustrates a perspective view of the outside of a spherical omnipresent loudspeaker 10 system, in accordance with a preferred embodiment of the present invention. FIG. 2 illustrates an exploded side view of the outside portions of the spherical omnipresent loudspeaker system shown in FIG. 1. The spherical omnipresent loudspeaker 10 is seen to comprise two hemispherical halves, an upper hemispherical half 12 and a lower hemispherical half 18. The upper hemispherical half 12 is hollow and preferably has holes through its surface over its entire surface. In a preferred embodiment, the holes are ⅛" in diameter with 36 holes per inch. One method of making it is termed "screen spinning" and is in common usage by metal fabrication companies. Other methods of manufacturing it include metal hydro-forming and plastic injection molding, of, for example, acrylic plastic, bioplastic, ABS, or PVC, or it may be made of polyvinyl or molded plastic product. There is also preferably a rim band 16 around its edge near the open end of the upper hemispherical half 12 where no holes are drilled, to preferably fit a decorative finish trim ring 17. The upper hemispherical half 12 may be otherwise constructed, including being made of molded perforated screen mesh material.

The upper hemispherical half 12 is then preferably covered in a grille cloth-type material, 14, such as acoustic transmitting polyester knit, by means, for example, of spray adhesive, 3M type or other. A decorative finish trim ring, 17 is preferably incorporated around the lower open end of the upper hemispherical half 12. The decorative finish trim ring 17 may be made of flexible U channel molding. Alternatively it may be made from other materials, such as formed metal, for example, brass or chrome. Shown in the drawings of FIG. 2 is a lower hemispherical half 18. The lower hemispherical half 18 forms a sound compression propagation vacuum chamber for the internal components, best seen in FIGS. 3 et seq. of loudspeaker 10, and internal components.

Figure 3:
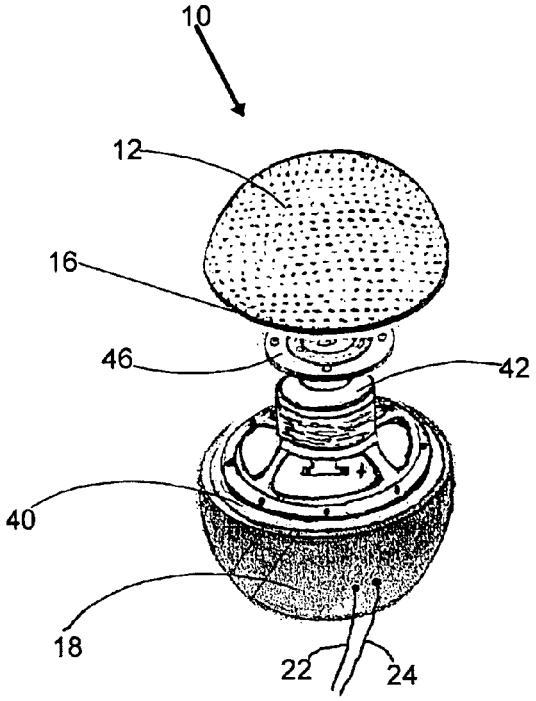
FIG. 3 illustrates a first partially assembled perspective view of a spherical loudspeaker system shown in FIG. 1.
Figure 4:
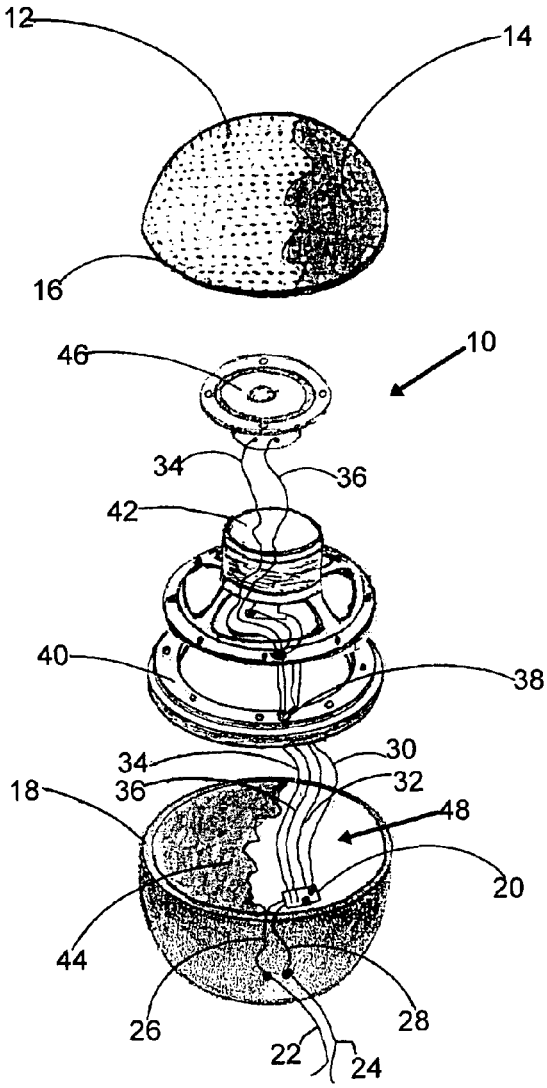
FIG. 4 illustrates a first exploded perspective view of a spherical loudspeaker system shown in FIG. 1.

FIG. 3 illustrates a first, partially assembled perspective view of the spherical loudspeaker system 10 shown in FIG. 1. FIG. 4 illustrates a first exploded perspective view of the spherical loudspeaker system 10 shown in FIG. 1. The lower hemispherical half 18 forms a sound compression propagation vacuum chamber 48. Incorporated within the lower hemispherical half 18 sound compression propagation vacuum chamber 48 is a crossover network 20, mounted into and onto the interior bottom of the lower hemispherical half 18, by means, for example, of adhesive caulking. Preferably, the crossover network 20 is screwed into a small disk of, for example, acrylic plastic, and bonded to the interior bottom of the lower hemispherical half 18. In these FIGS., the crossover network 20 is shown with two pairs of output terminals, corresponding to the two sound drivers 42, 46, as shown. This is illustrative only, as other numbers of output terminals may be implemented to control and drive other numbers of sound drivers. In a preferred embodiment, incorporated approximately 70° (degrees) from the lower hemispherical half axis of the novel spherical omnipresent loudspeaker 10, is a pair of input signal terminals 22, 24, mounted through the wall of the lower hemispherical half 18 sound compression propagation vacuum chamber 48. The input terminals 22, 24 have positive and negative connectors connecting to conductors 26, 28, and then connected to crossover network 20 input terminals. Crossover network 20 typically has one pair of output terminals for each sound driver it controls and drives. In this embodiment, connected to crossover network 20 are two pairs of conductors 30, 32 and 34, 36. The first pair of conductors 30, 32, are coupled to, and drive the low frequency sound driver 42, while the second pair of conductors 34, 36 are coupled to and drive the high frequency sound driver 46. The opposite ends of conductors 30, 32, 34, 36 are operably connected up through a hole 38, for example, drilled through low frequency sound driver mounting plate disk 40.

The low frequency sound driver mounting plate disk 40 will typically have its center cut out to accommodate the low frequency sound driver 42. The low frequency sound driver 42 is then typically mounted, inverted, onto the low frequency sound driver mounting plate disk 40, by means of, for example, a seal gasket and screws for the low frequency sound driver 42. Conductors 30, 32 are positive and negative and are connected to input terminals of a, for example, 3.5 mm stereo jack (not shown). There is preferably a 3.5 mm stereo plug (not shown) which plugs into the top portion of mounting plate disk 40 hole 38 to activate the low frequency sound driver 42, the high frequency sound driver 46, and, optionally, an intermediate frequency sound driver (not shown). The lower hemispherical half 18 sound compression propagation vacuum chamber 48, is then preferably lined with, for example, 1" inch acoustic padding 44 by means of, for example, spray adhesive. The low frequency sound driver 42 is mounted onto mounting plate disk 40 and sealed thereto in an air-tight manner by means of, for example, gasket and screws. The opposite end of the stereo plug has its positive and negative wires conventionally connected to the terminal inputs for the low frequency sound driver 42 and the high frequency sound driver 46.

Incorporated into the driver mounting plate disk 40 is an air vacuum valve 60 (see FIG. 6) used to extract air from the airtight lower hemispherical sound compression propagation vacuum chamber 48. The lower frequency sound driver 42 with air vacuum valve 60 and mounting plate disk 40 is mounted onto and into the upper-most portion of the lower hemispherical half 18 by means of, for example, acrylic bonding glue to form an air-tight seal between the lower hemispherical half 18 and the mounting plate disk 40, thus forming the sound compression propagation vacuum chamber 48. Air is extracted from the sound compression propagation vacuum chamber 48 typically using the air vacuum valve 60 until a specified atmospheric pressure is reached, in Hg or torr, based on, for example, the size of the sound compression propagation vacuum chamber 48. One means of extracting air vacuum from sound compression propagation vacuum chamber 48 is with an aerospace-type vacuum pump. Other methods are also within the present invention, including assembling and sealing the vacuum chamber 48 in a reduced atmospheric pressure chamber. Also, in alternative embodiments, the air vacuum valve 60 may, instead, be utilized to create a stable high-pressure environment by injecting in air or replacing air with an inert gas, such as argon. The high frequency sound driver 46 is preferably bonded to the back side of the inverted low frequency sound driver 42 by means of, for example, JB Weld or other means, and optionally, may be drilled and tapped to accommodate metal threaded fasteners. The stereo plug (not shown) is then plugged into stereo jack (not shown). The opposite end of the stereo plug typically has four conductors, two (2) positive and two (2) negative. Conductors 34 and 36 are connected to the appropriate input terminals of the high frequency sound driver 46. The upper hemispherical half 12 is then fitted over and onto the top of the lower hemispherical half 18, thereby making the completion of the novel spherical omnipresent loudspeaker 10.

Figure 5:
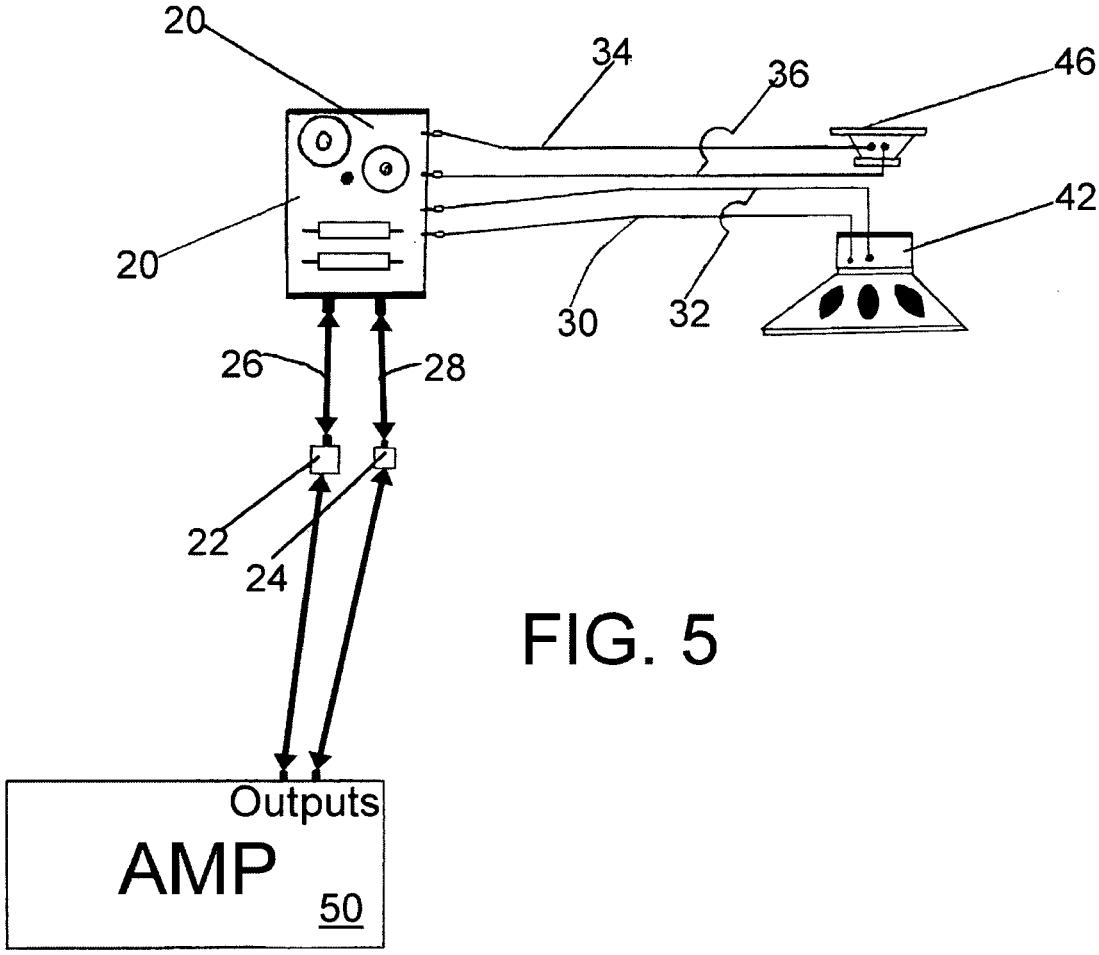
FIG. 5 illustrates a circuit diagram of a spherical loudspeaker system shown in FIG. 1.

FIG. 5 illustrates a circuit diagram of a spherical loudspeaker system shown in FIG. 1. An audio amplifier 50 is coupled to and drives the spherical loudspeaker system 10 through a pair of input signal terminals 22, 24. The pair of input signal terminals 22, 24, are coupled to, drive, and control the crossover network 20 via a corresponding pair of input signal terminal conductors 26, 28. Other numbers of pairs of input terminals and conductors are also within the scope of this invention. The crossover network 20 is coupled to, controls, and drives the low frequency sound driver 42 via a first pair of connectors 30, 32 and is coupled to, controls, and drives the high frequency sound driver 46 via a second pair of connectors 34, 36.

Figure 6:
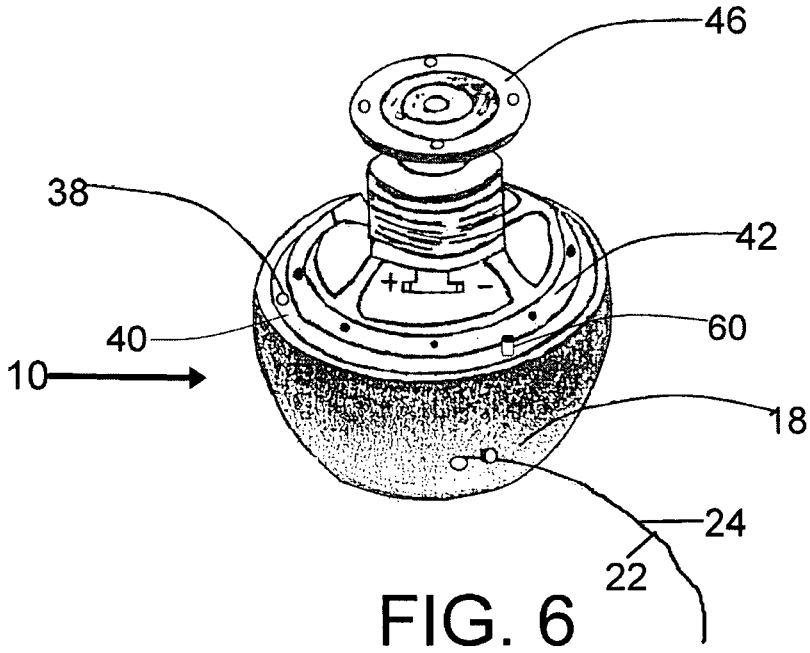
FIG. 6 illustrates a second partially assembled perspective view of a spherical loudspeaker system shown in FIG. 1.

FIG. 6 illustrates a second partially assembled perspective view of the spherical loudspeaker system shown in FIG. 1. The low frequency sound driver 42, is inverted and then mounted onto mounting plate disk 40. The low frequency sound driver 42, and its mounting plate disk 40 are lowered onto and into the lower hemispherical half 18 at the upper most portion of its open end. The mounting plate disk 40 preferably has its outer edge routed at approximately ¼" inch in depth and ⅛" inch wide to accommodate the upper hemispherical half 12 and is sealed air-tight approximately, for example, ½" into and below the upper-most portion of the open end of lower hemispherical half 18 forming sound compression propagation vacuum chamber 48. The mounting plate disk 40 is typically sealed air tight by means of, for example, acrylic bonding glue to the lower hemispherical sound chamber 48. Optionally, it can also be sealed by other means. The mounting plate disk 40 can be made of various materials, including, for example, acrylic, ABS plastic, bioplastic, or metal. It may be made in various ways, including cutting it to shape, injection molding, and hydroforming. Optionally, the lower hemispherical sound chamber 48 can be made together with mounting plate disk 40, molded as a complete unit formed from, for example, as a polyvinyl chloride (PVC) and acrylonitrile butadiene styrene (ABS) molded plastic product or by hydro-forming from materials such as aluminum.

Seen in FIG.6 is relatively high frequency sound driver, 46. The upwardly-facing high frequency sound driver 46 is preferably mounted to the back side of inverted low frequency sound driver 42, by means of, for example, liquid steel, (sometimes know as J-B Weld products.). A second pair of conductors, 34 36 come up through a hole 38 in mounting plate disk 40, and are connected to positive and negative input terminals of the high frequency sound driver 46.

The upper hemispherical half 12, acts as a free air sound reinforcement chamber and speaker cover in conjunction with the low frequency sound driver 42 and the high frequency sound driver 46. As seen in FIG.2, the upper hemispherical screen half 12, grille cloth 14, and finish trim ring 16, complete the upper-most portion of the novel spherical omnipresent loudspeaker 10. The upper hemispherical half 12 is fitted over and onto the top of lower hemispherical sound compression propagation vacuum chamber 48, thereby making the completion of the novel spherical omnipresent loudspeaker 10.

Figure 7:
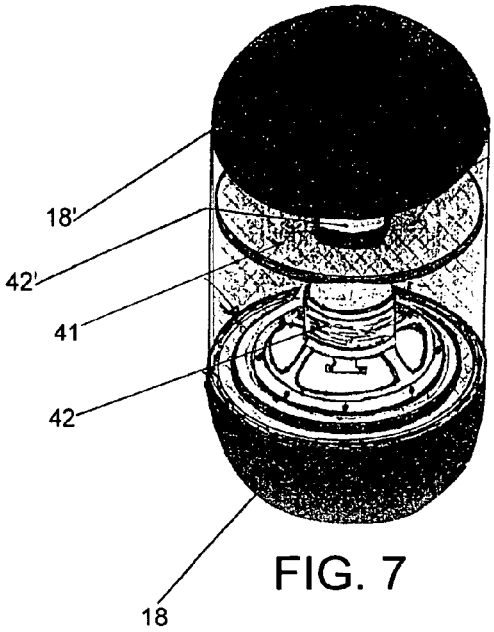
FIG. 7 illustrates a partially assembled perspective view of a spherical loudspeaker system in accordance with an alternate embodiment of the present invention.
Figure 8:
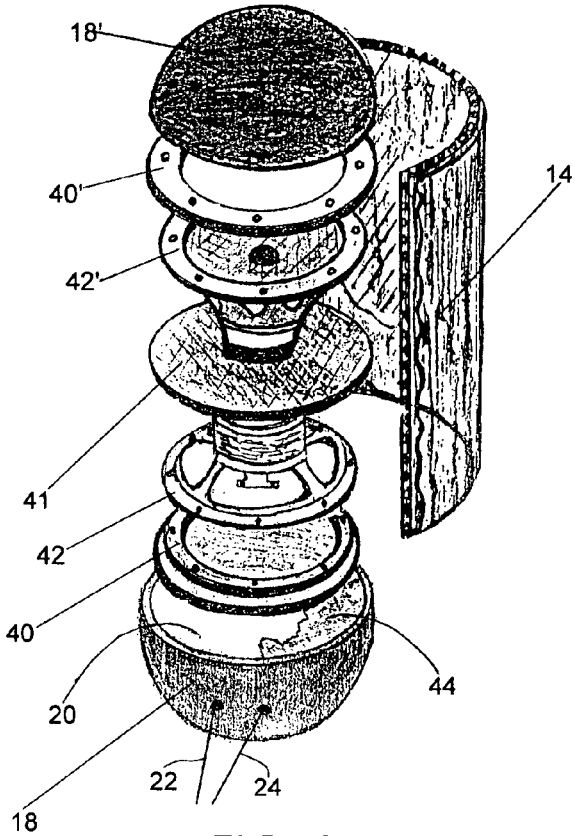
FIG. 8 illustrates an exploded perspective view of a spherical loudspeaker system, in accordance with the alternate embodiment of the present invention.

FIG. 7 illustrates a partially assembled perspective view of a loudspeaker system in accordance with an alternate embodiment of the present invention. FIG. 8 illustrates an exploded perspective view of a loudspeaker system, in accordance with this alternate embodiment. This alternate embodiment can be utilized, for example, in implementing a subwoofer. In both FIGS., the construction of the lower hemispherical half 18 is identical to that shown for FIGS. 2 through 6. As shown, this embodiment differs in that instead of utilizing a free air sound reinforcement chamber in the upper hemispherical half 12 (see FIGS. 3, 4, and 6), a second sound compression propagation vacuum chamber is formed in the upper hemispherical half 18', utilizing a second low frequency speaker 42', this time mounted facing up, instead of down.

Thus, a second low frequency sound driver 42' is mounted in a second mounting plate disk 40', and both are installed and sealed air tight into upper hemispherical half 18' in a manner equivalent to that utilized to install and seal the first low frequency sound driver 42 mounted in the first mounting plate disk 40 into the lower hemispherical half 18. The two hemispherical halves 18, 18' are then joined, as above, optionally separated by a plate 41. The first low frequency sound driver 42 and the second low frequency sound driver 42' may share output from the crossover network 20 if they are designed for reproducing comparable frequency ranges, or alternatively may be controlled separately by the crossover network 20 if designed to respond to different frequency ranges. A grille cloth-type material 14 extends between the upper and lower hemispherical halves and surrounds the drivers.

In yet another alternative embodiment (not shown), the upper hemispherical half 12 is separated from the lower hemispherical half 18 by, for example, a cylinder, typically constructed in a similar manner and of the same materials as the upper hemispherical half 12 when it contains a high frequency sound driver 46. The lower hemispherical half 18 is attached to the bottom of the cylinder and the upper hemispherical half 12 is attached to the top of the cylinder. The cylinder may contain a third sound driver, such as, for example, an intermediate frequency sound driver. Different combinations of these components are also within the scope of this invention. Also note that while the low frequency sound driver 42 faces down and the high frequency sound driver 46 faces up in the preferred embodiment, other orientations are also within the scope of this invention. For example, the omnipresent loudspeaker system can be rotated 180° with the low frequency sound driver 42 facing up, or 90°, with it facing to one side.

Those skilled in the art will recognize that modifications and variations can be made without departing from the spirit of the invention. Therefore, it is intended that this invention encompass all such variations and modifications as fall within the scope of the appended claims.

What is claimed is:

1. A speaker system comprising:

a first hollow hemispherical speaker housing having a hemispherical side and an opposing side with an interior and an exterior; and a first sound driver having a back and a front, said front mounted inverted facing into the interior of said first hemispherical speaker housing toward its interior and mounted in such a manner that an air-tight first sound compression propagation vacuum chamber is formed between the front of said first sound driver and facing into said interior of the first hemispherical speaker housing, the first sound compression propagation vacuum chamber maintaining a constant gas pressure within the first sound compression propagation vacuum chamber in the first hemispherical speaker housing whenever the first sound driver is inactive.

2. The speaker system in claim 1 which further comprises:

a second hollow hemispherical speaker housing having a hemispherical side and an opposing side with an interior and an exterior; and a second sound driver positioned in the interior of the second hemispherical speaker housing.

3. The speaker system in claim 2 wherein:

the first sound driver is a relatively low frequency sound driver;

the second sound driver is a relatively high frequency sound driver; and the speaker system further comprises:

a crossover network coupled to and for driving the first sound driver and the second sound driver; and a first set of connectors coupled to and for providing signals to control and drive the crossover network.

4. The speaker system in claim 3 wherein:

the first sound driver and the second sound driver are mounted in opposite directions, facing away from each other.

5. The speaker system in claim 3 wherein:

the speaker system further comprises: a second set of connectors coupled to and for providing signals to control and drive the crossover network.

6. The speaker system in claim 3 wherein:

the speaker system further comprises: a grill cloth material covering the second hemispherical speaker housing.

7. The speaker system in claim 2 wherein:

the first sound driver and the second sound driver are both relatively low frequency sound drivers; and the second sound driver is mounted inverted facing into the interior of the second hemispherical speaker housing toward its interior mounted in such a manner that an air-tight second sound compression propagation vacuum chamber is formed between the front of said second sound driver and the interior of said second hemispherical speaker housing, the second sound compression propagation vacuum chamber maintaining a constant gas pressure within the second hemispherical speaker housing whenever the second sound driver is inactive.

8. The speaker system in claim 2 wherein:

the first hemispherical speaker housing and the second hemispherical speaker housing are joined together to form a sphere; and the speaker system further comprising: a decorative ring mounted at the join between the first hemisphere speaker housing and the second hemisphere speaker housing.

9. The speaker system in claim 1 wherein: the speaker system further comprises:

a vacuum valve mounted to allow evacuation of air from the first sound compression chamber in order to provide for a lowered gas pressure as the constant gas pressure within the first sound compression propagation vacuum chamber.

10. The speaker system in claim 1 wherein: the speaker system further comprises:

a vacuum valve mounted to allow introduction of an inert gas into the first sound compression chamber, and first sound compression chamber is filled with an inert gas.

11. The speaker system in claim 1 wherein: the speaker system further comprises:

a vacuum valve mounted to allow introduction of air into the first sound compression chamber in order to provide for an increased gas pressure as to the constant gas pressure within, and the first sound compression chamber which contains and maintains air at an increased or decreased gas pressure when compared to a gas pressure of the ambient atmosphere.

12. The Speaker System in claim 1 which further comprises:

acoustic padding lining the interior of the first hollow hemispherical speaker housing within the first sound compression propagation vacuum chamber.

13. A speaker system comprising:

a spherical speaker housing having a hollow first hemispherical portion having an exterior and an interior and a hollow second hemispherical portion having exterior and an interior;

a relatively high frequency sound driver having a back and a front mounted facing into the interior of the first hemispherical portion resulting in a free air sound reinforcement chamber;

a relatively low frequency sound driver having a back and a front;

a relatively low frequency sound driver mounting plate disk, wherein:

the relatively low frequency sound driver is mounted inverted onto the relatively low frequency sound driver mounting plate disk; and the relatively low frequency sound driver mounting plate disk and the relatively low frequency sound driver are mounted inverted in an airtight manner with the front of the low frequency sound driver sealed to and facing into the interior of the second hemispherical portion, the interior of the second hemispherical portion forming a sound compression propagation vacuum chamber maintaining a constant gas pressure within whenever the relatively low frequency sound driver is inactive.

14. The speaker system in claim 13 wherein:

the speaker system further comprises: a crossover network coupled to and for driving the relatively low frequency sound driver and the relatively high frequency sound driver; and a first input terminal coupled to and capable of controlling and driving the crossover network.

15. The speaker system in claim 14 which further comprises:

a second input terminal coupled to and for controlling and driving the crossover network.

16. The speaker system in claim 13 which further comprises:

a decorative ring mounted between the first hemispherical portion and the second hemispherical portion.

17. The speaker system in claim 13 wherein:

the relatively low frequency sound driver mounting plate disk is constructed from acrylic.

18. The speaker system in claim 13 wherein:

the relatively low frequency sound driver mounting plate disk and the second hemispherical portion are formed together from molded plastic.

19. The speaker system in claim 13 wherein:

the speaker system further comprises: acoustic padding lining the interior of the second hemispherical portion within the sound compression propagation vacuum chamber.

20. The speaker system in claim 13 wherein:

the first hemispherical portion is substantially covered by a regular pattern of holes and is covered by a grill cloth material.

21. A sound system comprising:

a hollow spherical speaker housing having a first hemispherical portion and a second hemispherical portion, both portions having an exterior and an interior, wherein:

the first hemispherical portion is covered by a regular pattern of holes over its entire surface;

a relatively high frequency sound driver mounted in the interior of the first hemispherical portion resulting in a free air sound reinforcement chamber;

a relatively low frequency sound driver having a back and a front;

a relatively low frequency sound driver mounting plate disk, wherein:

the relatively low frequency sound driver is mounted in and through the relatively low frequency sound driver mounting plate disk; and the relatively low frequency sound driver mounting plate disk and the relatively low frequency sound driver are mounted in an airtight manner with the front of the low frequency sound driver facing into the interior of the second hemispherical portion and forming a sound compression propagation vacuum chamber maintaining a reduced atmospheric pressure within;

a vacuum valve mounted to allow evacuation of air from the sound compression chamber in order to provide for the lowered atmospheric pressure within;

acoustic padding lining the interior of the second hemispherical portion;

a crossover network coupled to and for driving the relatively low frequency sound driver and the relatively high frequency sound driver;

a first input terminal and a second input terminal, each coupled to and for controlling and driving the crossover network; and a grill cloth material covering the first hemispherical portion.

* * * * *